US007032829B2

(12) United States Patent
Schwarzbich

(10) Patent No.: US 7,032,829 B2
(45) Date of Patent: Apr. 25, 2006

(54) DEVICE FOR ADJUSTING A RAIL ON A RAIL SUBSTRUCTURE

(76) Inventor: Jörg Schwarzbich, Wertherstrasse 15, Bielefeld (DE) 33615

( * ) Notice: Subject to any disclaimer, the term of this patent is extended or adjusted under 35 U.S.C. 154(b) by 0 days.

(21) Appl. No.: 10/466,503

(22) PCT Filed: Feb. 4, 2002

(86) PCT No.: PCT/EP02/01138

§ 371 (c)(1),
(2), (4) Date: Oct. 31, 2003

(87) PCT Pub. No.: WO02/063099

PCT Pub. Date: Aug. 15, 2002

(65) Prior Publication Data

US 2004/0065746 A1 Apr. 8, 2004

(30) Foreign Application Priority Data

Feb. 8, 2001 (DE) ..... 201 02 160 U

(51) Int. Cl.
*E01B 9/38* (2006.01)

(52) U.S. Cl. ..... 238/281

(58) Field of Classification Search ..... 238/264, 238/265, 281, 282
See application file for complete search history.

(56) References Cited

U.S. PATENT DOCUMENTS 1,781,251 A * 11/1930 Schwendt et al. ..... 238/281
2,823,866 A * 2/1958 Jennison ..... 238/281
4,632,308 A * 12/1986 Fischer ..... 238/265

FOREIGN PATENT DOCUMENTS

DE 894020 10/1953

* cited by examiner

*Primary Examiner*—S. Joseph Morano
*Assistant Examiner*—Robert J. McCarry, Jr.
(74) *Attorney, Agent, or Firm*—Richard M. Goldberg

(57) ABSTRACT

An apparatus for adjusting a rail (10) on a rail substructure (18), includes a support plate (24) which supports the rail (10) and is held on the rail substructure (18) by means of bolts (30) arranged on both sides of the rail, and rotatable adjusting units (28) which are each associated with one of the bolts (30) for adjusting the support plate (24) relative to the bolts (30), wherein the adjusting units (28) are coupled by a gear mechanism (46, 48, 66, 48) for being adjusted synchronously.

19 Claims, 3 Drawing Sheets

DEVICE FOR ADJUSTING A RAIL ON A RAIL SUBSTRUCTURE

The invention relates to an apparatus for adjusting a rail on a rail substructure, comprising a support plate which supports the rail and is held on the rail substructure by means of bolts that are arranged on both sides of the rail, and two rotatable adjusting units which are each associated with one of the bolts for adjusting the support plate relative to the bolts.

When a railroad track is installed, the rails must be adjusted precisely in both, lateral direction and in height, in order to permit a motion of the rail car as uniform as possible. Conventionally, the support plate which supports the rail is fixed by at least two bolts that are anchored in the rail ties. In a known adjusting apparatus, the adjusting units for the lateral adjustment of the rail are formed by eccentrics which are each arranged on one of the bolts, so that the base plate and hence the rail can be adjusted in lateral direction by rotating both eccentrics simultaneously. The height adjustment has typically been achieved by inserting leveling plates of an appropriate thickness between the rail base and the support plate. The rail base is held by elastic clamps which are biased against the rail base either by means of said bolts or by means of separate nuts or bolts. Then the resiliency of the clamps permits to absorb any possible height differences between the rail base and the support plate.

When the rails are adjusted, at first, the lateral and vertical deviations between the target position and the actual position of the rail are measured by means of a measuring car traveling on the rail track, and, then, a corresponding lateral adjustment or height adjustment is performed on the basis of the measurement results.

SUMMARY OF THE INVENTION

It is an object of the invention to simplify these adjusting operations.

According to the invention, this object is achieved by the feature that the adjusting units are coupled by a gear mechanism so as to be adjusted synchronously. The gear mechanism transmits the rotary movement of one adjusting unit, e.g. an eccentric, to the other adjusting unit which is disposed on the opposite side of the rail. Thus, the two adjusting units are positively coupled, so that both adjusting units are adjusted synchronously when a torque is exerted on one of the adjusting units. When the adjusting units are formed by eccentrics, for example, it is no longer necessary to rotate both eccentrics synchronously in order to avoid a mutual locking of the excentrics. Thus, the adjusting operation is greatly facilitated. In particular, it is possible that one of the adjusting units is rotated by means of an appropriate tool about a predefined angle which corresponds to the measured deviation between the target position and the actual position, so that the rail is precisely adjusted to the target position.

Advantageous embodiments and further developments of the invention are indicated in the dependent claims.

The invention is not limited to a lateral adjustment of the rail, but can also be applied for a height adjustment of the rail. In this case, the adjusting units are each formed by two sleeves which are arranged on one of the bolts and are in thread-engagement with one another. When the sleeves that are positively coupled with one another by the gear mechanism are rotated synchronously by a certain angle, the result is a height adjustment of the support plate in proportion to the said angle and the thread pitch. The positive coupling assures that the support plate retains its horizontal position. The height adjustment is performed in a non-tensioned state of the bolts. Since the threaded sleeves are arranged directly on the bolts, they can stably bear the tension moments of the bolts when the latter are tensioned later on. Thus, a bending strain on the support plate is avoided.

In a preferred embodiment, the gear mechanism comprises an intermediate gear which is arranged between the two adjusting units and meshes with toothed rings formed on the rotatable adjusting units. When the apparatus is configured for height adjustment, the intermediate gear is preferably formed on another threaded sleeve which is in thread-engagement with a base sleeve that is non-rotatably arranged just underneath the rail. In this case, the weight of the rail and the rail car traveling thereon can easily be supported by three pairs of threaded sleeves. The central pair of threaded sleeves may have a larger diameter, so that it has a larger support capacity. The intermediate gear may have a larger number of teeth than the toothed rings on the two other threaded sleeves. Then, however, in order to achieve a uniform stroke of all three threaded sleeves, the thread pitch of the central pair of sleeves must have the same proportion relative to the thread pitch of the outer pairs of sleeves as the numbers of teeth.

In a particularly preferred embodiment, the adjusting units are configured for both, height adjustment and lateral adjustment. This may be achieved for example by providing two eccentrics that are rotatably supported in a lower base plate and each accommodate one of the bolts in an eccentric bore and have toothed rings that are coupled to one another by an intermediate gear. An adjusting tool provided with a gear may be inserted into the apparatus such that said gear meshes with one of the toothed rings or else with the intermediate gear. Thus, by rotating the adjusting tool, the eccentrics may be rotated synchronously, so that the base plate is shifted in a lateral direction relative to the bolts. Coaxially to the axis of rotation of each eccentric, there is arranged a base sleeve which is in thread-engagement with a height-adjustable telescopic sleeve. The intermediate gear is surrounded by a non-rotatable third base sleeve which is in thread-engagement engagement with a third telescopic sleeve. This third telescopic sleeve has a toothed ring serving as the intermediate gear and meshing with toothed rings of the other two telescopic sleeves. In this way, the rotatary movements of the telescopic sleeves relative to the respective base sleeves are synchronized with one another. For driving the telescopic sleeves, the above-mentioned adjusting tool or a second adjusting tool with a corresponding construction may be used. All three telescopic sleeves, together, support the support plate for the rail base. Thus, the support plate may be adjusted in height by rotating the telescopic sleeves, whereas a rotation of the eccentrics has the effect that the support plate is shifted laterally together with the base plate, the base sleeves and the telescopic sleeves.

Due to the thread-engagement between the base sleeves and the telescopic sleeves and due to the gear transmission between the adjusting tool and the toothed rings of the telescopic sleeves, it is possible to generate high adjusting forces, so that a height adjustment of the support plate and the associated rail may be performed while the measuring car is on the rail track. In this way, it is possible to measure the position of the rails and then to perform the adjusting operation immediately, with the result of the adjusting operation being monitored by means of the measuring car.

Adjusting apparatuses of the type indicated above may be used in pairs for the left and right rails of the track. These adjusting apparatuses, each of which supports one of the rails of the track, may be arranged directly on a flat concrete track bed like conventional rail ties, so that the whole rail substructure is formed by the flat track bed and the adjusting apparatuses anchored thereon by means of the bolts. As a result, it is no longer necessary to arrange pre-fabricated rail ties on the track bed. This greatly facilitates not only the adjustment of the rails but also the construction of the rail substructure, so that considerable cost savings can be achieved.

An embodiment example of the invention will not be described in conjunction with the drawings, in which:

DETAILED DESCRIPTION

Figure 1:
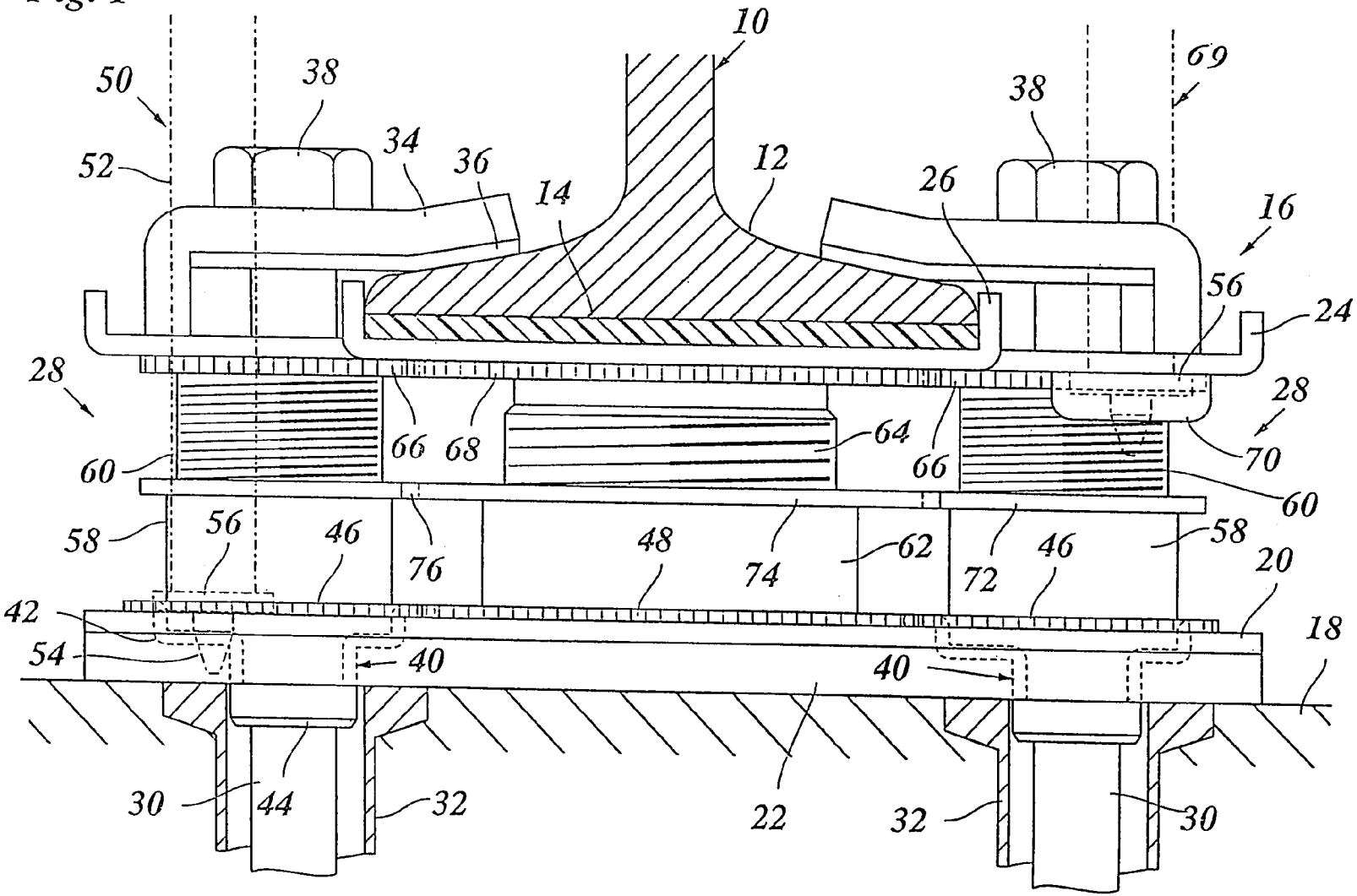
FIG. 1 is a view of an adjusting apparatus mounted on a flat track bed and supporting a rail which has been shown in cross-section

In FIG. 1, only the rail base 12 of a rail 10 of a rail track has been shown, the rail base being supported on a flat concrete track bed 18 via a noise-absorbing intermediate layer 14 and an adjusting apparatus 16. The adjusting apparatus 16 has a base plate 20 which is supported on the track bed 18, again via a noise-absorbing intermediate layer 22. On the top side, the adjusting apparatus 16 has a support plate 24 which bears the weight of the rail 10 and has upwardly bent ribs or tabs 26 between which the rail base 12 is inserted. The support plate 24 is sometimes designated as a rib plate. Between the base plate 20 and the support plate 24, two adjusting units 28 are arranged, which permit a height adjustment of the support plate 24 relative to the base plate 20.

The adjusting apparatus 16 is anchored in the track bed 18 by means of two bolts 30 which are arranged on opposite sides of the rail 10. To this end, two dowels 32 are embedded in the concrete of the track bed 18, and one of the bolts 30 is screwed into each of these dowels. Each of the dowels 32 has a lower portion, which is not shown in the drawings and which is provided with a relatively coarse external thread with which the dowel may be screwed into the fresh concrete after the track bed 18 has been concreted, as is described in German patent application DE 100 54 041.

In the example shown, a clamping plate 34 is provided on each of the bolts 30, and the clamping plate has a noise-absorbing and high-friction coating 36 on its bottom side and is firmly biased against the rail base 12 by the head 38 of the bolt. Thus, by means of the bolts 30 and the dowels 32 tightly anchored in the track bed 18, the rail 10 and the adjusting apparatus 16 are tightly biased against the surface of the track bed. The intermediate layers 14, 22 and the noise-absorbing coatings 36 of the clamping plates 34 suppress the transmission of solid-borne noise to the environment, so that the traveling noise of the rail car is greatly reduced. Likewise, the transmission of vibrations into the bolts 30 and the dowels 32 is suppressed. The high-friction coating 36 of the clamping plates also contributes to an increased axial holding force for the rail 10.

Optionally, it is also possible to replace the clamping plates 34 by bent, spring-elastic clamps according to the prior art. Moreover, while in the shown embodiment the clamping plates 34 are directly held on the bolts 30 which also serve for fixing the adjusting apparatus 16, it is possible in a modified embodiment to fix the clamping plates 34 or the clamps on the support plate 24 by means of separate bolts.

Each adjusting unit 28 has an eccentric 40 which has a pot-shaped top portion 42 rotatably supported in the base plate 20. The pot-shaped portion 42 merges downwardly into an eccentric bushing 44 which is penetrated by the bolt 30 and engages through an opening in the intermediate layer 22 into the top end of the dowel 32 (or is alternatively thrust onto a projecting top end of the dowel). A toothed ring 46 is formed at the top edge of the pot-shaped portion 42.

The two toothed rings 46 of both adjusting units 28 mesh with an intermediate gear 48. In this way, the two eccentrics 40 are coupled to one another with a transmission ratio of 1:1.

For adjusting the eccentric 40, an adjusting tool 50 is provided which is shown only in dashed lines on the left side in FIG. 1. This adjusting tool 50 has a shaft 52 which can be inserted from above in a position offset from the adjusting unit 28 through an opening in the support plate 24 and then rotatably engages a hole of the base plate 20 with a pin 54 formed at its lower end. Above the pin 54, the shaft 52 carries a gear 56 which meshes with the toothed ring 46 of the eccentric 40. When the shaft 52 is rotated by means of a drive mechanism which has not been shown, both eccentrics 40 are thus driven synchronously with a transmission ratio determined by the diameter of the gear 56. The rotation of the eccentrics 40 causes a shift of the bushings 44 relative to the axes of rotation of the eccentrics which are defined by the bearings in the base plate 20. Since the bushings 44 are fittingly engaged in the dowels 32, the whole adjusting mechanism 16 is shifted relative to the track bed 18. In this way, when the bolts 30 are not tightened, a simple and precise lateral adjustment of the rail 10 is possible.

Each adjusting unit 28 further comprises two threaded sleeves which are in thread-engagement with one another and which will be designated as a base sleeve 58 and a telescopic sleeve 60, for clarity. The base sleeves 58 are each arranged coaxially with the pot-shaped portion 42 of the associated eccentric 40 and have their lower ends rotatably engaged in the pot-shaped portion 42, as can be seen more clearly in FIG. 2. Between the two base sleeves 58, there is provided a third base sleeve 62 which has a larger diameter and is non-rotatably connected to the base plate 20. The intermediate gear 48 is rotatably held in an annular groove at the lower end of the base sleeve 62. A third telescopic sleeve 64 is screwed into the third base sleeve 62. The thread pitch of the external thread of the third telescopic sleeve 64 and the corresponding internal thread of the third base sleeve 62 is twice the thread pitch of the outer threaded sleeves 58, 60.

The telescopic sleeves 60 are rotatably journaled in the support plate 24 with their top ends and have a toothed ring 66 immediately below the support plate. The third telescopic sleeve 64 carries a toothed ring 68 which acts as an intermediate gear between the toothed rings 66, so that the rotatary movements of the two telescopic sleeves 60 are synchronized. The number of teeth and the pitch circle of the toothed ring 68 is twice the number of teeth and pitch circle, respectively, of each of the toothed rings 66, so that a transmission ratio of 2:1 is established between the telescopic sleeve 64 and each of the telescopic sleeves 60. Thus, due to this transmission ratio and due to the thread pitch of the telescopic sleeve 64, all three telescopic sleeves 60, 64 perform the same stroke, when rotated, so that the support plate 24 supported on the telescopic sleeves can be lifted and lowered evenly.

A drive mechanism for the telescopic sleeves 60, 64 for the height adjustment of the rail 10 may be formed either by the adjusting tool 50 that has been described already or by a second adjusting tool 69 having the same construction and being shown in dashed lines on the right side in FIG. 1. This adjusting tool 69 is also inserted through an opening in the support plate 24 and is then accommodated in a receptacle 70 on the bottom side of the support plate 24, such that its gear 56 meshes with the toothed ring 66 of the associated telescopic sleeve 60.

For performing a lateral adjustment and height adjustment of the rail 10, the bolts 30 are untightened. A measuring car, which has not been shown, travels on the rails of the track into a position above the adjusting apparatus 16 and measures the position of the rail 10. The adjusting tools 50, 69 can then be extended downwardly from the measuring car and can be driven by motors so as to perform the required lateral adjustment and height adjustment of the rail 10 by means of the adjusting apparatus 16. The result of the adjusting operation can then be monitored by means of the measuring car.

Since the lateral adjustment takes place only in a horizontal plane, in parallel with the surface of the track bed 18, whereas the height adjustment takes place only in vertical direction, the two adjusting operations are independent from one another, so that mutual interdependence is avoided.

The base sleeves 58 and 62 have flanges 72 and 74, respectively at their top ends. These flanges are interlocked with one another by meshing notches and teeth or alternatively by complete toothed rings, so that the base sleeves 58 will not rotate when the telescopic sleeves 60 are driven for rotation. This also prevents a co-rotation and hence a misadjustment of the eccentrics 40.

The weight of the rail 12 and the rail cars traveling thereon is evenly supported by three pairs of base sleeves and telescopic sleeves, without causing any bending strains in the support plate 24.

In order to prevent the entry of moisture, the adjusting units may be surrounded by seals of sponge rubber or in the form of protective bellows arranged between the base plate 20 and the support plate 24.

Figure 2:
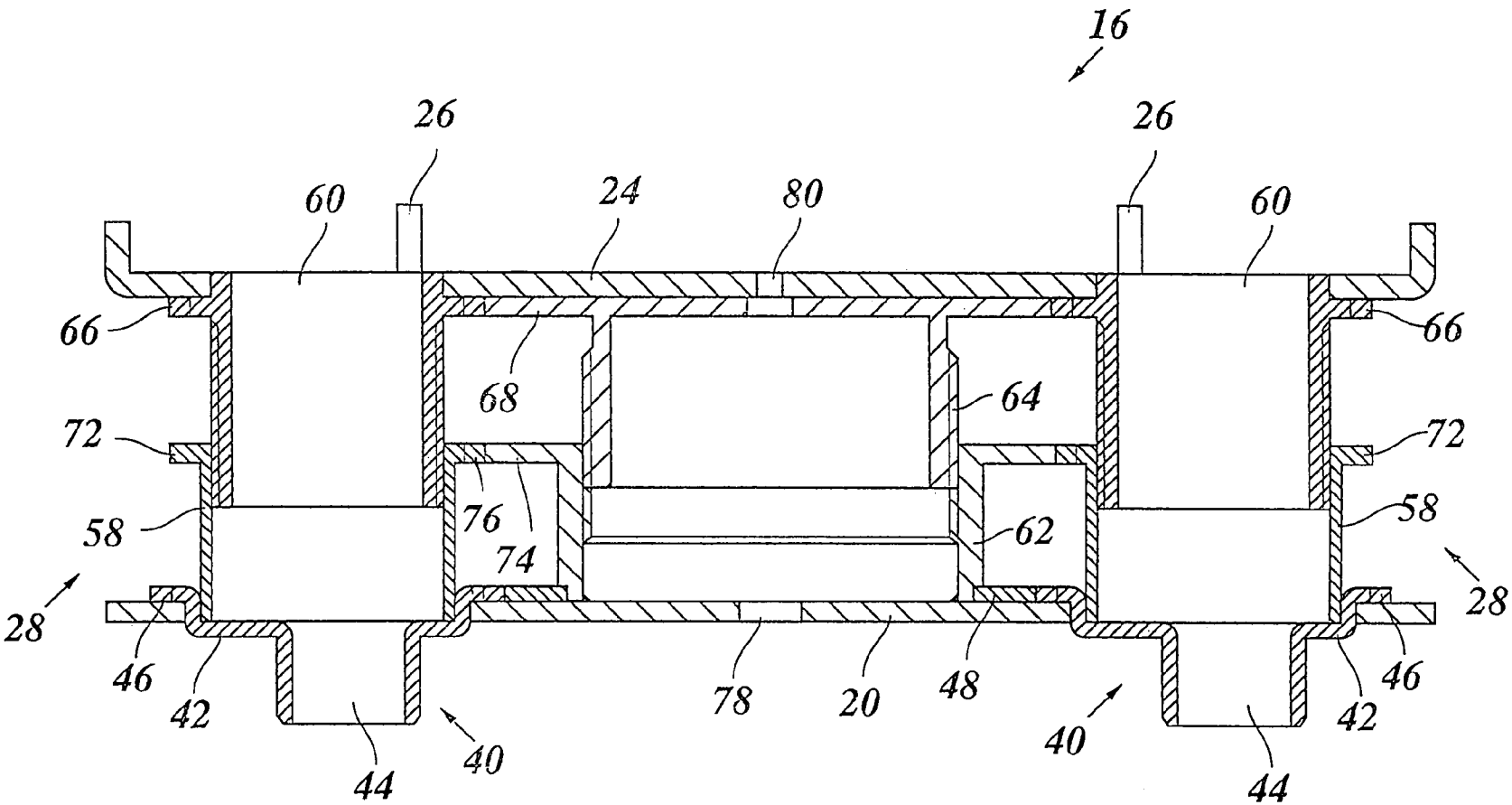
FIG. 2 is a cross-sectional view of the adjusting apparatus.

As is shown in FIG. 2, the base plate 20 and the support plate 24 have central bores 78, 80 which permit to hold the complete adjusting apparatus 16 together by means of a screw passing through the central bores.

Figure 3:
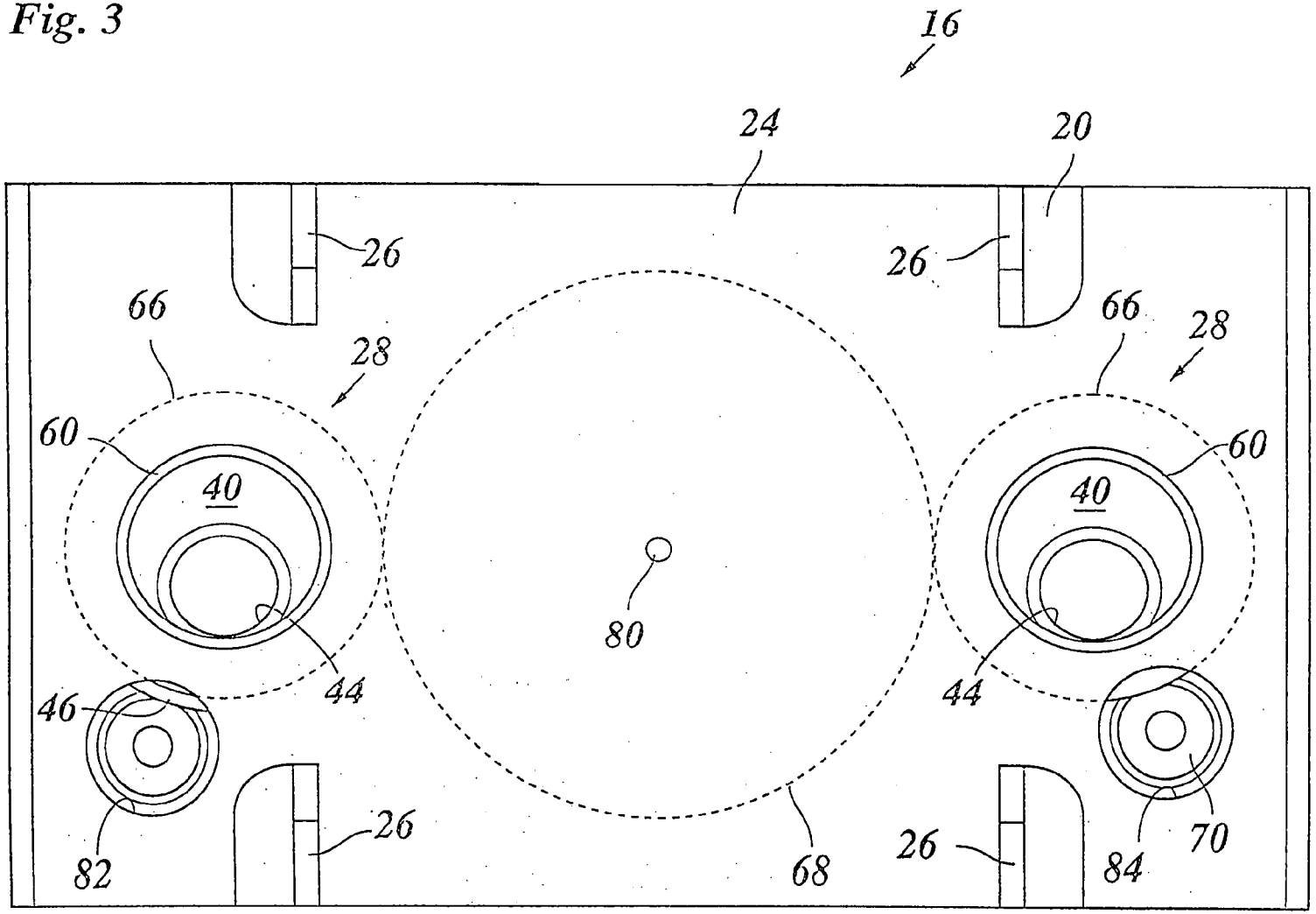
FIG. 3 is a top view of the adjusting apparatus shown in FIG. 2.

FIG. 3 shows the openings 82 and 84 formed in the support plate 24 for insertion of the adjusting tools 50, 69. In FIG. 3, the eccentrics 40 are shown in their neutral position, in which the bushings 44 are arranged symmetrically relative to the center of the adjusting apparatus 16.

In a modified embodiment, the gears 56 forming part of the adjusting tools 50, 69 may also be fixedly integrated in the adjusting apparatus, so that the adjusting tools are reduced to simple keys which engage in these gears.

What is claimed is:

1. An apparatus for adjusting a rail on a rail substructure, comprising:

a support plate which supports the rail and is held on the rail substructure by means of bolts arranged on both sides of the rail, two rotatable adjusting units, each associated with one of the bolts for adjusting the support plate relative to the bolts, each of the adjusting units including two members that are rotatable relative to one another to perform an adjustment operation, and a gear mechanism which couples the two adjusting units for synchronously adjusting the two adjusting units.

2. The apparatus according to claim 1, wherein the adjusting units each have an eccentric for a lateral adjustment of the rail.

3. The apparatus according to claim 2, wherein the gear mechanism comprises two toothed rings which are each formed at the eccentric of one of the adjusting units and are coupled to one another by an intermediate gear.

4. The apparatus according to claim 2, wherein each eccentric is rotatably journaled in a support structure which is rigidly connected to the support plate in a lateral direction, and each eccentric has a bushing arranged eccentrically relative to the axis of rotation and penetrated by the associated bolt.

5. The apparatus according to claim 4, wherein the bolts are each screwed into a dowel which has a top end and is anchored in the rail substructure, and the bushings engage the top ends of the dowels.

6. The apparatus according to claim 5, wherein the rail substructure is formed by a flat track bed made of concrete.

7. The apparatus according to claim 1, wherein each adjusting unit has a pair of threaded sleeves held in thread-engagement with one another for a height adjustment of the support plate.

8. The apparatus according to claim 7, wherein the gear mechanism has two toothed rings which are each formed on one of the threaded sleeves of each adjusting unit and are coupled with one another by an intermediate gear.

9. The apparatus according to claim 7, wherein the adjusting units each have an eccentric for a lateral adjustment of the rail, the gear mechanism comprises a first pair of toothed rings which are each formed at the eccentric of one of the adjusting units and are coupled to one another by a first intermediate gear, and the threaded sleeves of each adjusting unit comprise a base sleeve arranged coaxially with the axis of rotation of the eccentric and supported on said eccentric, and a telescopic sleeve which supports the support plate.

10. The apparatus according to claim 9, wherein the gear mechanism has a second pair of toothed rings which are each formed on one of the threaded sleeves of each adjusting unit and are coupled with one another by a second intermediate gear, said toothed rings of the second pair being formed on the telescopic sleeves which are rotatably journaled in the support plate, and the base sleeves being held non-rotatably relative to the support plate.

11. The apparatus according to claim 10, wherein a non-rotatable third base sleeve is arranged on the base plate between the base sleeves of the two adjusting units, the third base sleeve being in thread-engagement with a third telescopic sleeve supporting the support plate, and the second intermediate gear, which couples the toothed rings of the telescopic sleeves of the adjusting units, is formed by a toothed ring on the third telescopic sleeve.

12. The apparatus according to claim 11, wherein a ratio between a thread pitch of the third telescopic sleeve and a thread pitch of the other telescopic sleeves is equal to a ratio between a pitch circle of the second intermediate gear and pitch circles of the toothed rings of the telescopic sleeves of the adjusting units.

13. The apparatus according to claim 3, comprising an adjusting tool having a shaft adapted to be inserted from above through an opening of the support plate into the apparatus and driving a gear which meshes with one of the toothed rings.

14. The apparatus according to claim 9, comprising an adjusting tool having a shaft adapted to be inserted from above into the apparatus, and a gear mounted on said shaft, wherein the support plate has a first opening arranged near a first one of said adjusting units such that the gear of the adjusting tool, when inserted in the first opening, meshes with the toothed ring of the eccentric of said first adjusting unit, and the support plate has a second opening and a receptacle arranged near a second one of said adjusting units such that the gear of the adjusting tool, when inserted in the second opening and supported in said receptacle, meshes with the toothed ring of the telescopic sleeve of said second adjusting unit.

15. The apparatus according to claim 1, wherein the rail is fixed on the support plate by flat, rigid clamping plates adapted to be biased against a rail base of the rail.

16. The apparatus according to claim 15, wherein the clamping plates are arranged on said bolts and are adapted to be biased against the rail base through heads of said bolts.

17. The apparatus according to claim 16, wherein each of said clamping plates has a bottom side provided with a noise-absorbing and high-friction coating.

18. The apparatus of claim 3, comprising an adjusting tool having a shaft adapted to be inserted from above through an opening of the support plate into the apparatus and driving a gear which meshes with the intermediate gear.

19. The apparatus of claim 2, wherein each eccentric is rotatably journaled in a base plate which is fixedly coupled with the support plate in a lateral direction, and each eccentric has a bushing arranged eccentrically relative to the axis of rotation and penetrated by the associated bolt.

* * * * *